US006866189B2

(12) United States Patent
Nelson

(10) Patent No.: US 6,866,189 B2
(45) Date of Patent: Mar. 15, 2005

(54) RETAIL CARTON AND BAKING TRAY

(75) Inventor: Daniel J. Nelson, Chagrin Falls, OH (US)

(73) Assignee: Caraustar Custom Packaging, Grand Rapids, MI (US)

( * ) Notice: Subject to any disclaimer, the term of this patent is extended or adjusted under 35 U.S.C. 154(b) by 0 days.

(21) Appl. No.: 10/408,509

(22) Filed: Apr. 7, 2003

(65) Prior Publication Data

US 2004/0195301 A1 Oct. 7, 2004

(51) Int. Cl.[7] ..... B65D 17/00

(52) U.S. Cl. ..... 229/242; 229/164; 229/906; 229/125.35

(58) Field of Search ..... 229/242, 232, 229/120.21, 164, 903, 120.16, 186, 906, 125.35

(56) References Cited

U.S. PATENT DOCUMENTS

| | | | | |
|---|---|---|---|---|
| 887,729 | A | | 5/1908 | Kirmse |
| 900,953 | A | | 10/1908 | Reber |
| 901,286 | A | | 10/1908 | Ferres et al. |
| 1,430,149 | A | | 9/1922 | Bliss |
| 1,995,286 | A | | 3/1935 | Arzet |
| 1,998,717 | A | | 4/1935 | Guyer |
| 2,011,438 | A | | 8/1935 | Daller |
| 2,348,377 | A | | 5/1944 | Goodyear |
| 2,367,476 | A | | 1/1945 | Tyrseck |
| 2,369,387 | A | | 2/1945 | Williamson et al. |
| 2,369,392 | A | | 2/1945 | Ringler |
| 2,396,310 | A | | 3/1946 | Yungblut |
| 2,403,698 | A | | 7/1946 | Williamson et al. |
| 2,502,117 | A | | 3/1950 | Anderson |
| 2,717,074 | A | | 9/1955 | Williamson et al. |
| 2,766,923 | A | | 10/1956 | D'Esposito |
| 2,794,588 | A | | 6/1957 | George et al. |
| 2,836,343 | A | | 5/1958 | Will |
| 2,848,153 | A | | 8/1958 | Geiger, Sr. |
| 2,872,855 | A | | 2/1959 | Fahrenkrug |
| 2,881,967 | A | | 4/1959 | Ringler |
| 2,939,621 | A | | 6/1960 | Mittleman |
| 2,951,627 | A | | 9/1960 | Wenzel |
| 2,983,424 | A | | 5/1961 | Glass |
| 3,008,569 | A | | 11/1961 | Murch |
| 3,023,679 | A | | 3/1962 | Piazze |
| 3,078,028 | A | * | 2/1963 | Skowronski ..... 229/104 |
| 3,085,736 | A | | 4/1963 | Meyers |
| 3,140,809 | A | | 7/1964 | Hickin et al. |
| 3,161,346 | A | | 12/1964 | Svensson |
| 3,168,974 | A | | 2/1965 | Buttery et al. |
| 3,172,563 | A | | 3/1965 | Harwood |
| 3,197,114 | A | | 7/1965 | Holmes |
| 3,197,115 | A | | 7/1965 | Peter |

(List continued on next page.)

FOREIGN PATENT DOCUMENTS

| | | |
|---|---|---|
| CA | 1017728 | 9/1977 |
| CA | 1323608 | 10/1993 |
| DE | 2002995 | 7/1971 |
| DE | 2046484 | 3/1972 |
| DE | 3140389 A1 | 6/1983 |
| GB | 2229996 A | 10/1990 |
| JP | 5-97151 | 4/1993 |

*Primary Examiner*—Tri M. Mai
(74) *Attorney, Agent, or Firm*—Summa & Allan, P.A.

(57) ABSTRACT

A container is provided with a removable lid which allows for corner reinforcement structures to remain attached to the container after lid removal. According to one embodiment, the lid is removable via a combination of tear-away strips and reverse cuts. The container is preferably manufactured using a unitary blank and designed for easy construction and filling, convenient storage and display, and simple conversion into cooking and serving conformations.

17 Claims, 4 Drawing Sheets

U.S. PATENT DOCUMENTS 3,198,420 A 8/1965 Hiersteiner
3,207,416 A 9/1965 Koltz et al.
3,249,283 A 5/1966 Craddock et al.
3,295,743 A 1/1967 Redpath et al.
3,310,223 A * 3/1967 Buttery ..... 229/227
3,321,354 A 5/1967 Sloan et al.
3,322,264 A 5/1967 McNair et al.
3,345,918 A 10/1967 Simeone
3,355,995 A 12/1967 Borkmann et al.
RE26,371 E 4/1968 Schultz
3,385,428 A 5/1968 Kugler
3,432,090 A 3/1969 Engel
3,434,849 A 3/1969 Carbone
3,465,944 A 9/1969 Robinson
3,514,032 A 5/1970 Pierce
3,524,581 A 8/1970 Buttery
3,537,360 A 11/1970 Farnam
3,708,108 A 1/1973 Rosenburg, Jr.
3,710,396 A 1/1973 Tomlinson
3,727,827 A 4/1973 Stice
3,744,702 A 7/1973 Ellison
3,756,501 A 9/1973 Skillen et al.
3,774,838 A 11/1973 Christie
3,907,194 A 9/1975 Davenport et al.
3,910,486 A 10/1975 Stone
3,961,743 A 6/1976 Hollowell
3,963,173 A 6/1976 Stone
4,042,164 A 8/1977 Croley
4,048,052 A 9/1977 Tolaas
4,083,455 A 4/1978 Keating, Jr.
4,102,457 A 7/1978 Meyers
4,127,229 A 11/1978 Roccaforte
4,136,816 A 1/1979 Gardner
4,141,449 A 2/1979 Stone
4,284,193 A 8/1981 Roccaforte
4,289,239 A 9/1981 Meyers
4,314,643 A 2/1982 Forbes, Jr.
4,449,633 A * 5/1984 Johnson et al. ..... 229/123.2
4,531,669 A 7/1985 Osborne
4,542,847 A 9/1985 Lindstrom
4,679,694 A 7/1987 Donohie et al.
4,688,677 A 8/1987 Roccaforte
4,726,471 A 2/1988 Whately et al.
4,732,315 A 3/1988 Gunn
4,747,536 A 5/1988 Wischusen, III
4,768,703 A 9/1988 Sosler et al.
4,773,542 A 9/1988 Schillinger et al.
4,813,594 A * 3/1989 Brown et al. ..... 229/103
4,836,383 A * 6/1989 Gordon et al. ..... 229/232
4,871,345 A 10/1989 Wosaba, II et al.
4,948,038 A 8/1990 Moeller
4,981,256 A 1/1991 Giblin et al.
4,986,420 A 1/1991 Gunn et al.
4,997,087 A 3/1991 Lorenz
5,014,905 A 5/1991 Cassidy
5,036,982 A 8/1991 Aston
5,054,644 A 10/1991 Greenslade
5,078,273 A * 1/1992 Kuchenbecker ..... 229/207
5,085,323 A * 2/1992 Kuchenbecker et al. .... 229/207
5,092,516 A 3/1992 Kastanek
5,129,875 A 7/1992 Chaygneaud-Dupuy
5,148,973 A 9/1992 Zimmermann
5,154,343 A 10/1992 Stone
5,161,733 A 11/1992 Latif
5,161,734 A 11/1992 Ruchl et al.
5,170,934 A 12/1992 Lemoine
5,215,248 A 6/1993 Moser
5,219,089 A 6/1993 Kiolbasa et al.
5,236,123 A 8/1993 Stone et al.
5,238,179 A 8/1993 Hart
5,249,681 A 10/1993 Miller
5,265,799 A 11/1993 Stone
5,277,360 A 1/1994 DeMott
5,314,114 A 5/1994 Stone
5,320,279 A 6/1994 Giblin et al.
5,322,215 A 6/1994 Roccaforte
5,325,989 A 7/1994 Karalus
5,328,091 A 7/1994 Koss
5,330,099 A * 7/1994 Beales et al. ..... 229/207
5,363,981 A 11/1994 Giblin et al.
5,373,960 A 12/1994 Gunn et al.
5,439,133 A 8/1995 Stone
5,443,205 A 8/1995 Robotham et al.
5,505,374 A 4/1996 Stone
5,515,996 A 5/1996 Stone
5,551,938 A 9/1996 Stone
5,553,773 A 9/1996 Focke et al.
5,588,587 A * 12/1996 Stier et al. ..... 229/232
5,624,031 A 4/1997 Fowler et al.
5,641,118 A * 6/1997 Benham ..... 229/125.35
5,673,849 A 10/1997 Stone
5,725,144 A 3/1998 Stone et al.
5,743,462 A 4/1998 Stone
5,775,576 A 7/1998 Stone

* cited by examiner

RETAIL CARTON AND BAKING TRAY

FIELD OF THE INVENTION

The present invention relates generally to packaging and more specifically relates to a carton for use in retail packaging and display as well as in cooking.

BACKGROUND OF THE INVENTION

The retail food packaging and distribution industry has seen immense growth in recent years. Grocery stores and restaurants are increasingly finding that consumers demand high-quality foods that are easy and quick to prepare, and these foods require specialized packaging to make the overall experience, from purchase to dining, convenient to the customer. In addition to being easy to use, the ideal food carton is also easy to manufacture and fill, and compact in relation to the container's contents.

Many existing food cartons require special construction techniques or special opening techniques that make the cartons difficult to construct and fill for the food packager or retailer, and difficult to open and user for the consumer. Further, many cartons now in use come in odd shapes and sizes, often because the requirement of a removable lid on a carton puts constraints on reasonable carton shapes. Specialized cartons are frequently difficult and costly to construct and use in a mass-marketing environment. An ideal carton should be economical and ecological to manufacture, and versatile in its uses, being useful for food display and storage and for cooking. Further, a carton should maintain a high degree of structural integrity throughout all its uses.

The present invention is directed to a container that is easy to construct and fill, and also easy to use for the consumer to open and use, while maintaining carton strength throughout all its uses.

SUMMARY OF THE INVENTION

According to one embodiment of the present invention, a container is provided with an easy-to-open lid, with a top having reinforced corners after lid removal.

According to another embodiment of the present invention, a container is provided with two-way tearable opening portions that allow easy consumer access to contents.

According to still another embodiment of the present invention, a unitary container blank is provided which allows efficient construction of a food display, storage, and cooking container having an easy-to-open lid.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
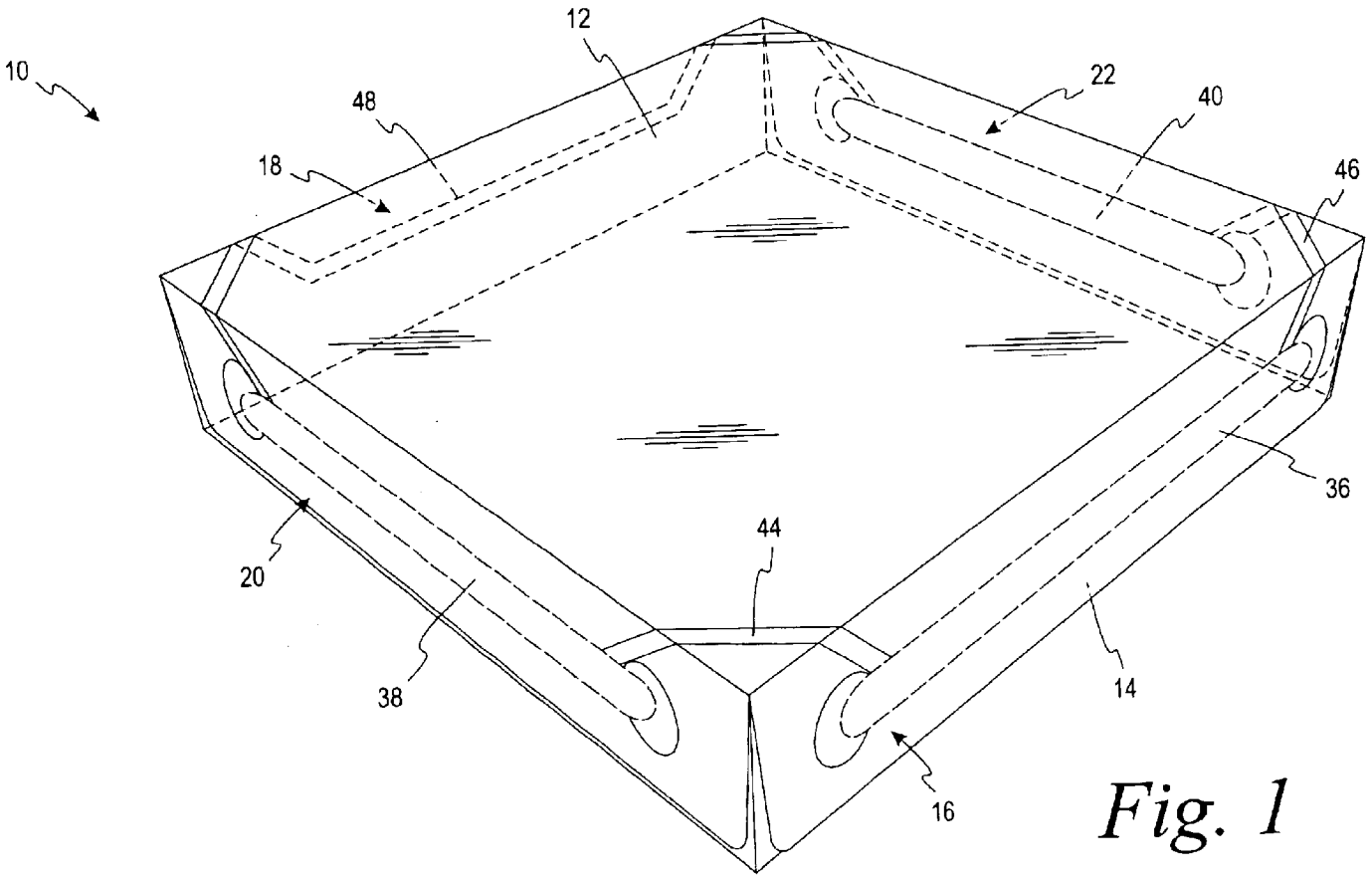
FIG. 1 is an isometric view of a container according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

A food container that is easily constructed and filled by a food producer, easily displayed by a retailer, and easily opened by a consumer achieves the optimum balance of features for each container user. FIG. 1 shows a container 10 that achieves these and other goals. The container 10 includes a removable lid 12 disposed above a bottom panel 14. The lid 12 is supported above the bottom panel 14 by a front wall 16, a back wall 18, and first and second side walls 20 and 22. The dotted lines of FIG. 1 indicate that the dotted portions would not be visible due to perspective. According to one embodiment of the container 10, the front wall 16 and the first and second side walls 20 and 22 are two-ply walls that are constructed of inner and outer wall panels connected to each other, as will be better appreciated by viewing FIG. 2.

Figure 2:
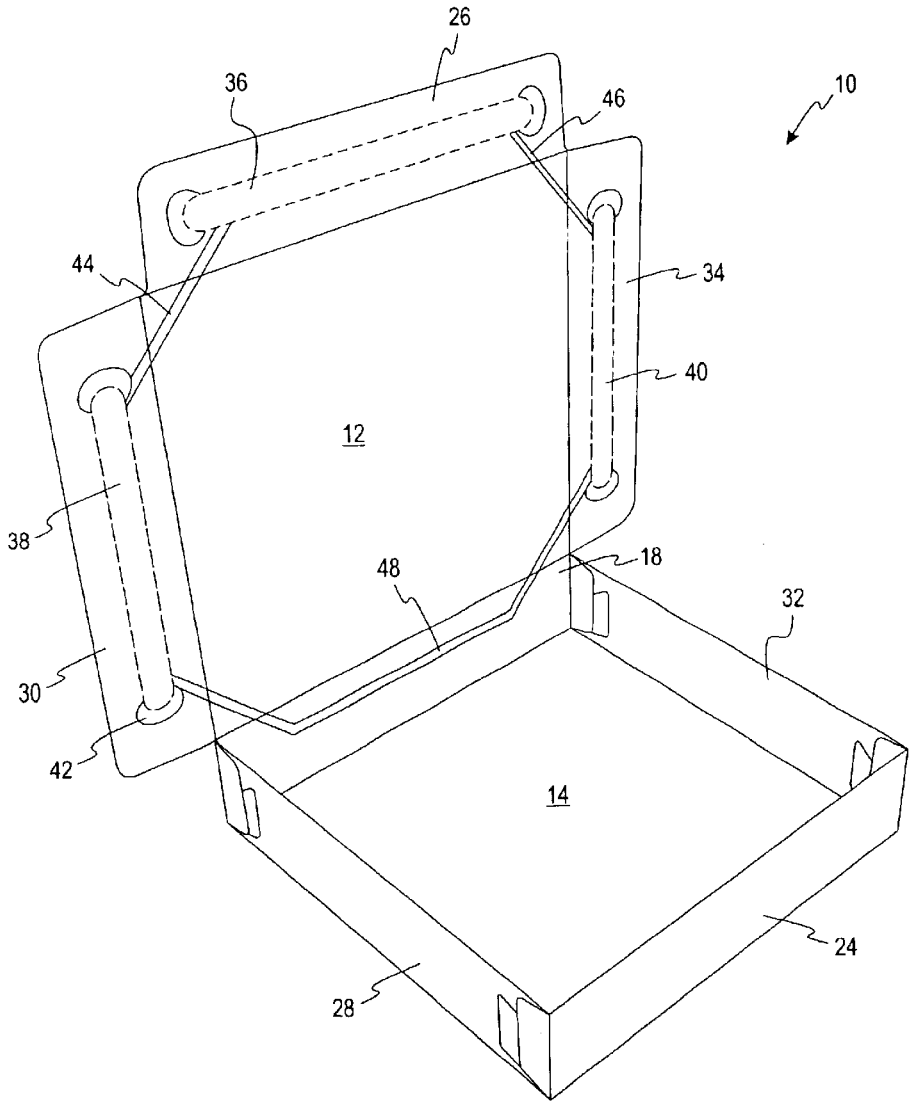
FIG. 2 is an isometric view of a container according to one embodiment of the present invention with an open lid showing connection flaps.

Turning now to FIG. 2, the container 10 is shown with the lid 12 in an open position prior to attachment of the inner and outer wall panels to each other. The front wall 16 is formed of an inner front panel 24 and an outer front panel 26, the first side wall is formed of an inner first side panel 28 and an outer first side panel 30, and the second side wall is formed of an inner second side panel 32 and an outer second side panel 34. The back wall 18 is formed of a single panel.

The lid 12 is removable via a combination of reverse cuts and tear-away strips, with the tear-away strips forming the majority of the removable connection along the front and sides of the container 10 and the reverse cuts allowing for removal of the lid 12 along the corners and back of the container 10. A front tear-away strip is located on the outer front panel 26, a first side tear-away strip 38 is located on the outer first side panel 30, and a second side tear-away strip 40 is located on the outer second side panel 34. Preferably, each of the tear-away strips is tearable in both directions to enable easy use of the container 10 by right-handed as well as left-handed users. According to one embodiment, each of the bidirectional tear-away strips terminates at an access cutout 42 at each end.

The tear-away strips work in conjunction with reverse cuts to allow the lid 12 to be easily removed from the container for access to the container's contents. The first front reverse cut 44 provides a removable bridge between the front tear away strip 36 and the first side tear-away strip 38, and the second front reverse cut 46 provides a removable bridge between the front tear-away strip 36 and the second side tear-away strip 40. A rear reverse cut 48 provides a removable bridge along the rear of the container 10 between the first side tear-away strip 38 and the second side tear-away strip 40. As shown in FIG. 1, the lid 12 is constructed such that a portion of the lid 12 overlaps each of the front wall 16, the back wall 18, and the first and second side walls 20 and 22. According to one embodiment of the present invention, the reverse cuts are provided with cut widths of approximately 3/16 inch, though wider or narrower reverse cuts may be employed in specific applications of the present invention.

To remove the lid 12 from the container 10, a user simply pulls off the tear-away strips 36, 38, and 40 in any order. After removal of a tear-away strip, the portion of the lid overlapping the corresponding wall from which the tear-away strip was removed is accessible to a user for pulling. Thus, to completely remove the lid 12 following removal of the tear-away strips 36, 38, and 40, a user must simply pull upwardly on an overlapping portion of the lid 12 to cause the removal of the lid 12 along the reverse cuts 44, 46, and 48.

Figure 3:
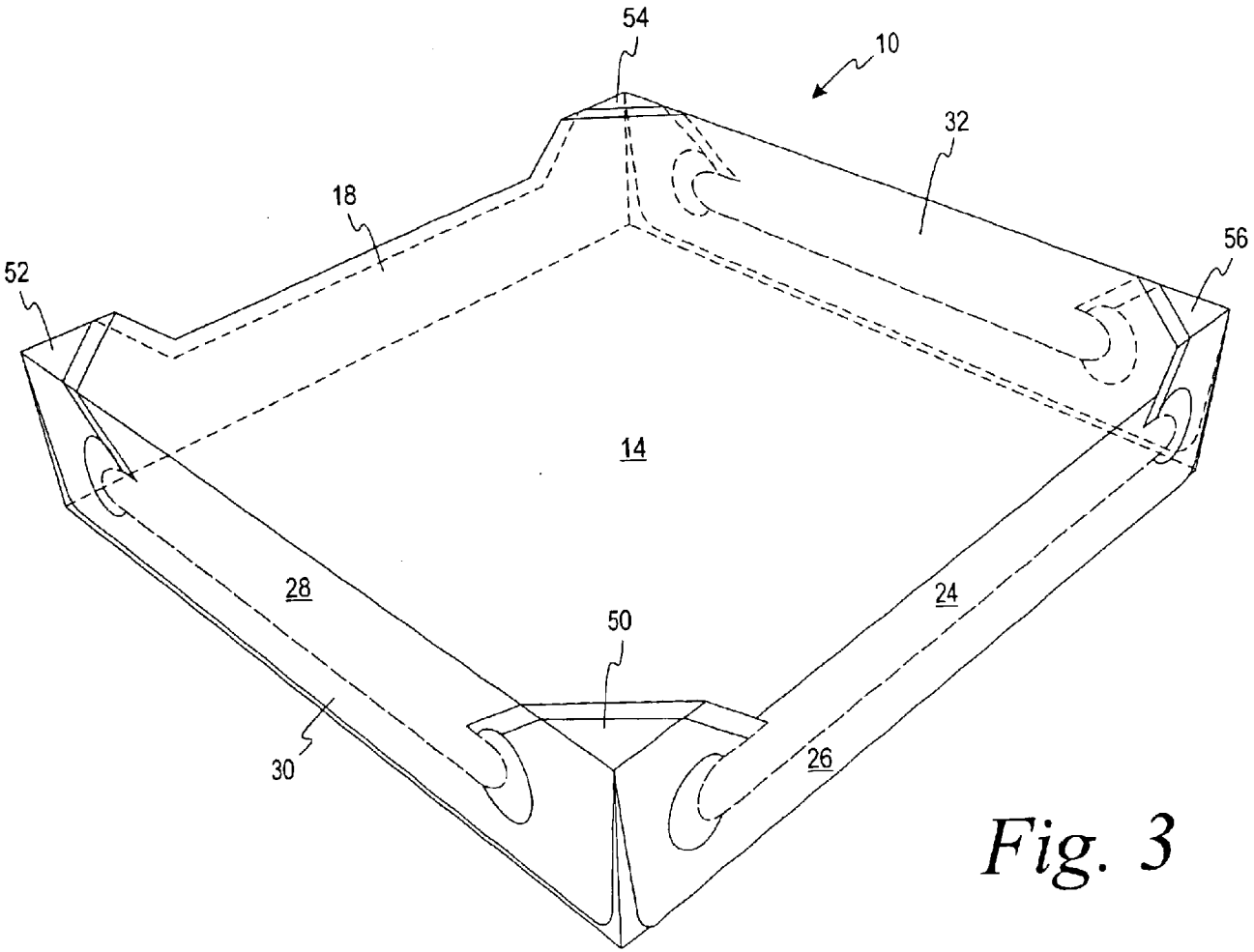
FIG. 3 is an isometric view of a container according to one embodiment of the present invention with its lid removed.

As shown in FIG. 3, the removal of the lid 12 from the container of FIG. 1 results in first, second, third, and fourth corner reinforcement flaps 50, 52, 54, and 56 being left on the container 10. The corner reinforcement flaps 50, 52, 54, and 56 serve to maintain the structural integrity of the container 10 even after the lid 12 has been removed.

Figure 4:
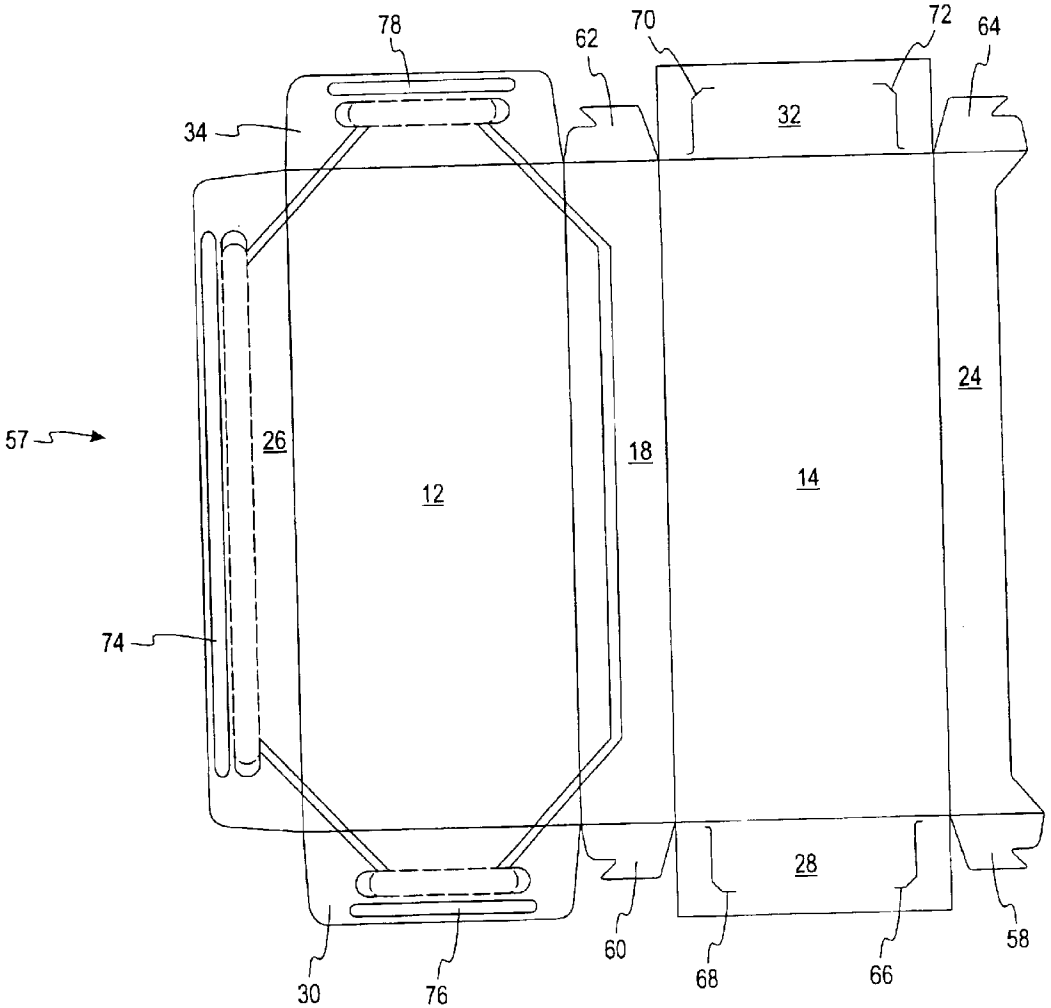
FIG. 4 is a plan view of a blank for constructing a container according to one embodiment of the present invention.

Turning now to FIG. 4, a blank 57 for constructing a container according to one embodiment of the present invention is shown. The blank 57 comprises construction segments adapted to form components of an assembled container. According to one embodiment of the blank 57, container construction is aided by the use of construction tabs 58, 60, 62, and 64 and construction slots 66, 68, 70, and 72. To construct a container, the inner first and second side panels 28 and 32 are folded upwardly to a position approximately perpendicular to the bottom panel 14. The inner front panel is folded upwardly to a position approximately perpendicular to the bottom panel 14 and the construction tabs 58 and 64 are inserted respectively into the construction slots 66 and 72. Next, the back wall 18 is folded upwardly to a position approximately perpendicular to the bottom panel 14 and the construction tabs 60 and 62 are inserted respectively into the construction slots 68 and 70.

The lid 12 is then folded downwardly into a position approximately parallel to the bottom panel 14, and the outer front panel 26, and the outer first and second side panels 30 and 34 are respectively attached to the inner front panel 24 and the inner first and second side panels 28 and 32. This connection may be accomplished with a front glue line 74 and first and second side glue lines 76 and 78. The front glue line 74 adhesively attaches a lower portion of the outer front panel 26 with a lower portion of the inner front panel 24. Likewise, the first side glue line 76 adhesively attaches a lower portion of the outer first side panel 30 with a lower portion of the inner first side panel 28, and the second side glue line 78 adhesively attaches a lower portion of the outer second side panel 34 with a lower portion of the inner second side panel 32. After folding and attaching of the blank portions as described, a container 10 as shown in FIG. 1 is assembled, with sealing on all sides adequate for food storage, display, and preparation.

A container according to the present invention is preferably provided as a dual-ovenable container, capable of use in food storage during freezing and refrigeration as well as food preparation in an oven or microwave oven. It is preferable to use a combination of hot melt and wet glue. According to this embodiment, dots of hot melt glue may be used to establish a quick tack, with wet glue adhesive adding the capability of withstanding a range of temperatures encountered in carton applications. According to one embodiment of the present invention, the removable lid 12, following removal, allows for expansion of a food product, such as rising dough, above the walls of the container. Further, the construction of a container according to one embodiment of the present invention allows for adequate sealing of a food product within the container without the need for additional wrapping, such as an inner bag, within the container.

A container according to the present invention may be constructed of a variety of materials. Paperboard is one preferred material for container construction, and corrugated paperboard may also be used, with either vertical or horizontal fluting being possible. Other materials for manufacture include paperboard, paperboard composites consisting of paperboard or corrugated paperboard with plastic film or foil and susceptor laminates, corrugated cardboard, corrugated or uncorrugated plastic sheeting, foam materials, and other packaging materials. According to one embodiment of the present invention, the lid 12 may be partially opened by removing only certain ones of the tear-away strips or opening only certain ones of the reverse cuts to allow steam escape during cooking.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container for holding and cooking food products comprising:

a bottom panel;

a front wall, a back wall, a first side wall, and a second side wall extending upwardly from said bottom panel;

a lid extending across said front wall, said back wall, said first side wall, and said second side wall, and above said bottom panel, said lid having overlapping portions which extend downwardly to said front wall, said back wall, said first side wall, and said second side wall, and lid being removably attached to said front wall and said first and second side walls, respectively, along a front tear-away strip and first and second side tear-away strips and to said back wall along a rear reverse cut;

a first front reverse cut that extends from an edge of said first side tear-away skin across a portion of said first side wall, said lid, and said front wall to an edge of said tear-away strip; and a second front reverse cut that extends from an edge of said second side tear-away strip across a portion of said second side wall, said lid, and said front wall to another edge of said front tear-away strip;

wherein said first front reverse cut defines a removable bridge between said front tear-away strip and said first side tear-away strip; and wherein said second front reverse cut defines a removable bridge between said front tear-away strip and said second side tear-away strip; and wherein said rear reverse cut extends from another edge of said first side tear-away strip across portions of said first side wall, said lid, said back wall, and said second side wall to another edge of said second side tear-away strip such that said rear reverse cut defines a removable bridge that extends along said back wall between said first and second side tear-away strips.

2. The container of claim 1 wherein each of said tear-away strips is bidirectional.

3. The container of claim 2 wherein each of said tear-away strips is bordered by an access cutout at each end thereof.

4. The container of claim 1 wherein said lid is further connected to said container along said first and second front reverse cuts located at first and second front corners of said lid.

5. The container of claim 4 further comprising a first corner reinforcement flap adjoining said front wall and said first side wall, a second corner reinforcement flap adjoining said first side wall and said back wall, a third corner reinforcement flap adjoining said back wall and said second side wall, and a fourth corner reinforcement flap adjoining said second side wall and said front wall, each of said corner reinforcement flaps extending partially toward a center of said container and being approximately parallel to said bottom panel.

6. The container of claim 5 wherein said first corner reinforcement flap is bordered by said first front reverse cut, said second and third corner reinforcement flaps are bordered by said rear reverse cut, and said fourth corner reinforcement flap is bordered by said second front reverse cut.

7. A container for the storage, display, and preparation of food comprising:

a bottom panel;

a front wall comprising an outer front panel and an inner front panel;

a first side wall comprising an outer first side panel and an inner first side panel;

a second side wall comprising an outer first side panel and an inner first side panel;

a back wall;

a lid removably attached to said front wall, said first side wall, and second side wall, and said back wall, said lid extending above said bottom panel and terminating along a front edge at a front tear-away strip, terminating at a first side edge at a first side tear-away strip, terminating at a second side edge along a second side tear-away strip, and terminating at a rear edge along a rear reverse cut;

a first corner reinforcement flap extending across a top of said container between said front wall and said first side wall;

a second corner reinforcement flap extending across said top of said container between said first side wall and said back wall;

a third corner reinforcement flap extending across said top of said container between said back wall and said second side wall; and a fourth corner reinforcement flap extending across top of said container between said second side wall and said front wall;

wherein said lid further terminating along said first corner reinforcement flap at a first front reverse cut, along said fourth corner reinforcement flap at a second front reverse cut, and along second and third corner reinforcement flaps along said reverse cut; and wherein portions of said lid partially overlap each of said front wall, said first side wall, and said second side wall to define a front overlapping portion, a first side overlapping portion, and a second side overlapping portion, respectively.

8. The container of claim 7 wherein said front tear-away strip is disposed between said front overlapping portion of said lid and said outer front panel, said first side tear-away strip is disposed between said first side overlapping portion of said lid and said outer first side panel, and said second side tear-away strip is disposed between said second side overlapping portion of said lid and said outer second side panel.

9. The container of claim 7 wherein said outer front panel is adhesively connected along a lower portion thereof to a lower portion of said inner front panel, said outer first side panel is adhesively connected along a lower portion thereof to a lower portion of said inner first side panel, and said outer second side panel is adhesively connected along a lower portion thereof to a lower portion of said inner second side panel.

10. The container of claim 9 wherein said tear-away strips and said reverse cuts provide sufficient sealing strength to contain food within the container during freezing, refrigeration, and cooking.

11. The container of claim 7 wherein an inner edge of said first corner reinforcement flap comprises said first front reverse cut and an inner edge of said fourth corner reinforcement flap comprises said second front reverse cut.

12. The container of claim 11 wherein an inner edge of said second corner reinforcement flap comprises a first portion of said rear reverse cut and an inner edge of said third corner reinforcement flap comprises a second portion of said rear reverse cut.

13. The container of claim 11 wherein said outer front panel and said inner front panel are attached along a front glue line.

14. The container of claim 11 wherein said outer first side panel and said inner first side panel are attached along a first side glue line and said outer second side panel and said inner second side panel are attached along a second side glue line.

15. A blank for constructing a container comprising:

a bottom panel segment;

a back wall segment hingedly connected to said bottom panel segment;

a lid segment hingedly connected to said back wall segment opposite said bottom panel segment;

an outer front panel segment hingedly connected to said lid segment opposite said back wall segment;

an inner front panel segment hingedly connected to said bottom panel segment opposite said back panel segment;

an inner first side panel segment hingedly connected to said bottom panel segment;

an inner second side panel segment hingedly connected to said bottom panel segment opposite said inner first side panel segment;

an outer first side panel segment hingedly connected to said lid segment;

an outer second side panel segment hingedly connected to said lid segment opposite said outer first side panel segment;

a first front reverse cut diagonally extending from said outer front panel segment, through a first corner of said lid segment, and into said outer first side panel segment;

a second front reverse cut diagonally extending from said outer front panel segment, through a second corner of said lid segment, and into said outer second side panel segment; and rear reverse cut having: (a) a first diagonal portion diagonally extending from said outer first side panel across a third corner of said lid segment and into said back wall segment; (b) a straight portion extending from said first diagonal portion across said back wall segment; and (c) a second diagonal portion diagonally extending from said straight portion across a fourth corner of said lid segment and into said outer second side panel.

16. The blank of claim 15 further comprising:

first and second construction slots provided within said inner first side panel segment;

third and fourth construction slots provided within said inner second side panel segment;

a first construction tab hingedly connected to said inner front panel segment;

a second construction tab hingedly connected to said back wall segment;

a third construction tab hingedly connected to said back wall segment opposite said second construction tab; and a fourth construction tab hingedly connected to said inner front panel segment opposite said first construction tab.

17. The blank of claim 15 further comprising:

a front tear-away strip within said outer front panel segment;

a first side tear-away strip within said outer first side panel segment; and a second side tear-away strip within said outer second side panel segment.

* * * * *

UNITED STATES PATENT AND TRADEMARK OFFICE

CERTIFICATE OF CORRECTION

PATENT NO. : 6,866,189 B2
DATED : March 15, 2005
INVENTOR(S) : Daniel J. Nelson

It is certified that error appears in the above-identified patent and that said Letters Patent is hereby corrected as shown below:

Column 4,
Lines 38 and 39, “side wall, and lid” should read -- side wall, said lid --.
Line 44, “tear-away skin” should read -- tear-away strip --.
Lines 45 and 46, “edge of said tear-away” should read -- edge of said front tear-away --.

Column 5,
Line 34, “wall, and second side” should read -- wall, said second side --.
Line 50, “across top of” should read -- across said top of --.
Line 57, “said reverse cut;” should read -- said rear reverse cut; --.

Signed and Sealed this

Twenty-seventh Day of September, 2005

JON W. DUDAS
*Director of the United States Patent and Trademark Office*